US011099504B2

(12) United States Patent
Minato

(10) Patent No.: US 11,099,504 B2
(45) Date of Patent: Aug. 24, 2021

(54) IMAGE FORMING APPARATUS

(71) Applicant: CANON KABUSHIKI KAISHA, Tokyo (JP)

(72) Inventor: Yusuke Minato, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/908,854

(22) Filed: Jun. 23, 2020

(65) Prior Publication Data

US 2020/0409291 A1 Dec. 31, 2020

(30) Foreign Application Priority Data

Jun. 29, 2019 (JP) ..... JP2019-122575

(51) Int. Cl.
*G03G 15/16* (2006.01)
*G03G 15/00* (2006.01)
*G03G 15/02* (2006.01)

(52) U.S. Cl.
CPC ..... *G03G 15/1675* (2013.01); *G03G 15/0266* (2013.01); *G03G 15/5037* (2013.01)

(58) Field of Classification Search
CPC ..... G03G 15/0266; G03G 15/1675; G03G 15/5037
See application file for complete search history.

(56) References Cited

U.S. PATENT DOCUMENTS 9,091,968 B2 * 7/2015 Hara ..... G03G 15/1675
2013/0294792 A1 11/2013 Hara et al.

FOREIGN PATENT DOCUMENTS

| | | | |
|---|---|---|---|
| JP | 2004-117920 | A | 4/2004 |
| JP | 2008-102558 | A | 5/2008 |
| JP | 2008-275946 | A | 11/2008 |
| JP | 2012-252247 | A | 12/2012 |
| JP | 2013-235058 | A | 11/2013 |

* cited by examiner

*Primary Examiner* — Hoang X Ngo
(74) *Attorney, Agent, or Firm* — Venable LLP

(57) ABSTRACT

An image forming apparatus includes an image bearing member, a transfer member, a voltage source, a current detecting portion, and a controller. When the recording material passes through the transfer portion, the controller is capable of changing the predetermined voltage on the basis of a detection result of said current detecting portion so that the detection result of the current detecting portion falls within a predetermined range. A maximum changeable amount per once of the predetermined voltage is larger when a leading end portion of the recording material with respect to a recording material feeding direction passes through the transfer portion than when a central portion of the recording material with respect to the recording material feeding direction passes through the transfer portion.

6 Claims, 13 Drawing Sheets

(a)

| | BASIS WEIGHT (gsm) | SET CURRENT (μA) | WATER CONTENT (g/kg) | | |
|---|---|---|---|---|---|
| | | | 0.9 | | 21.6 |
| PLAIN PAPER 1 | 64～75 | TGT *1 | 50 | ··· | 40 |
| | | UL *2 | 70 | ··· | 60 |
| | | LL *3 | 30 | ··· | 20 |
| PLAIN PAPER 2 | 76～105 | TGT *1 | 55 | ··· | 45 |
| | | UL *2 | 75 | ··· | 65 |
| | | LL *3 | 35 | ··· | 25 |
| ⋮ | ⋮ | ⋮ | ⋮ | | ⋮ |

(*1): "TGT" is the target current.

(*2): "UL" is the upper limit.

(*3): "LL" is the lower limit.

(b)

| | BASIS WEIGHT (gsm) | WATER CONTENT (g/kg) | | |
|---|---|---|---|---|
| | | 0.9 | | 21.6 |
| PLAIN PAPER 1 | 64～75 | 1000V | ··· | 200V |
| PLAIN PAPER 2 | 76～105 | 1150V | ··· | 150V |
| ⋮ | ⋮ | ⋮ | | ⋮ |

Fig. 6

IMAGE FORMING APPARATUS

FIELD OF THE INVENTION AND RELATED ART

The present invention relates to an image forming apparatus, such as a copying machine, a printer or a facsimile machine, using an electrophotographic type or an electrostatic recording type.

Conventionally, in the image forming apparatus using the electrophotographic type or the like, a toner image is electrostatically transferred from a photosensitive member or an intermediary transfer belt as an image bearing member onto a recording material such as paper. This transfer is carried out in many cases by applying a transfer voltage to a transfer member such as a transfer roller for forming a transfer portion in contact with the image bearing member. When the transfer voltage is excessively low, a "poor image density (transfer void)" such that the transfer is not sufficiently carried out and a desired image density cannot be obtained occurs in some instances. Further, when the transfer voltage is excessively high, electric discharge occurs at a transfer portion and a polarity of electric charges of toner of the toner image is reversed by the influence of the electric discharge, so that a "white void" such that the toner image is not partly transferred occurs in some instances. For that reason, in order to form a high-quality image, it is required that a proper transfer voltage is applied to the transfer member.

In Japanese Laid-Open Patent Application (JP-A) 2004-117920, the following control method of a transfer voltage in a constitution in which the transfer voltage is subjected to constant-voltage control has been disclosed. A predetermined voltage is applied to the transfer portion where the recording material is absent immediately before a start of continuous image formation and a current value is detected, so that a voltage value at which a predetermined target current is obtained is acquired. Then, a recording material part (sharing) voltage depending on the kind of the recording material is added to this voltage value, and a transfer voltage value applied in the constant voltage control during the transfer is set. By such control, it is possible to apply the transfer voltage depending on a desired (predetermined) target current through the constant-voltage control irrespective of a fluctuation in electric resistance value of the transfer portion such as the transfer member and a fluctuation in electric resistance value of the recording material.

Here, the kind of the recording material includes a kind depending on a difference in surface smoothness of the recording material such as high-quality paper or coated paper and a kind depending on a difference in thickness of the recording material such as thin paper or thick paper, for example. The recording material part voltage can be acquired in advance depending on such a kind of the recording material, for example. However, the kind of recording materials put in circulation is very large. Further, although the electric resistance of the recording material is also different depending on a moist state (water content of the recording material), the water content of the recording material fluctuates depending on a time or the like in which the recording material is placed in an environment even when the environment (temperature, humidity) is the same. For that reason, it is difficult to acquire the recording material part voltage in advance with accuracy in many instances. When the transfer voltage inclusive of an amount corresponding to the fluctuation in electric resistance of the recording material is not a proper value, as described above, an image defect such as the poor image density or the white void occurs in some instances.

In order to solve such a problem, in JP-A 2008-102558 and JP-A 2008-275946, in the constitution in which the transfer voltage is subjected to the constant-voltage control, it has been proposed that an upper limit and a lower limit of a current supplied to the transfer portion when the recording material passes through the recording material. The transfer current supplied to the transfer portion when the recording material passes through the transfer portion can be caused to fall within a predetermined range, and therefore, it is possible to suppress generation of the image defect due to excess and deficiency of the transfer current. In JP-A 2008-102558, the upper limit is acquired on the basis of environmental information. In JP-A 2008-275946, the upper limit and the lower limit are acquired depending on front/back of the recording material, the kind of the recording material and the size of the recording material in addition to the environmental information.

Incidentally, in the constitution in which the transfer voltage is subjected to the constant-voltage control, control in which a target voltage for the constant-voltage control of the transfer voltage is changed so that the current falls within a predetermined range in the case where the current flowing through the transfer member when the recording material passes through the transfer portion is also referred to as "limiter control". Further, here, a magnitude (high/low) of the voltage and the current is compared on an absolute value basis.

However, in the conventionally proposed limiter control, improper transfer occurs in an image at a leading end portion of the recording material with respect to a recording material feeding direction in some instances. This is because the limiter control is not in time at the leading end portion of the recording material with respect to the recording material feeding direction and a proper transfer voltage cannot be applied to the recording material when the image formed at the leading end portion passes through the transfer portion. FIG. 13 schematically shows a progression of a transfer voltage and a state of occurrence of an image defect in the case where an electric resistance of the recording material is high and a transfer current becomes insufficient when the leading end portion of the recording material passes through the transfer portion. In the limiter control, there arises a time lag from detection that the transfer current is out of the predetermined range is made until a change of the transfer voltage such that the transfer current falls within the predetermined range is completed. For that reason, in a region of the recording material passing through the transfer portion in a period from the detection of the transfer control until the change of the transfer voltage such that the transfer current falls within the predetermined range is completed, the transfer current is out of a proper range, and therefore, an image defect such as a lowering in (image) density due to excess and deficiency of the transfer current occurs in some instances.

On the other hand, when a change amount of the transfer voltage per unit feeding distance of the recording material in the limiter control is increased, a region in which there is a possibility that the improper transfer occurs can be narrowed. However, in this case, in the case where the change of the transfer current by the limiter control is carried out in the neighborhood of a central portion of the recording material with respect to the recording material feeding direction, due to an abrupt change of the transfer current, there is a risk such that density non-uniformity is rather noticeable.

SUMMARY OF THE INVENTION

A principal object of the present invention is to provide an image forming apparatus capable of suppressing density non-uniformity in the neighborhood of a central portion of a recording material with respect to a recording material feeding direction while suppressing improper transfer at a leading end portion of the recording material with respect to the recording material feeding direction in a constitution in which limiter control is carried out.

According to an aspect of the present invention, there is provided an image forming apparatus comprising: an image bearing member configured to bear a toner image; a transfer member forming a transfer portion configured to transfer the toner image from the image bearing member onto a recording material; a voltage source configured to apply a voltage to the transfer member; a current detecting portion configured to detect a current flowing through the transfer member; and a controller configured to effect constant-voltage control so that the voltage applied to the transfer member is a predetermined voltage when the recording material passes through the transfer portion, wherein when the recording material passes through the transfer portion the controller is capable of changing the predetermined voltage on the basis of a detection result of the current detecting portion so that the detection result of the current detecting portion falls within a predetermined range, and wherein a maximum changeable amount per once of the predetermined voltage is larger when a leading end portion of the recording material with respect to a recording material feeding direction passes through the transfer portion than when a central portion of the recording material with respect to the recording material feeding direction passes through the transfer portion.

Further features of the present invention will become apparent from the following description of exemplary embodiments with reference to the attached drawings.

Parts (a) and (b) of FIG. 6 are schematic views of tables relating to the secondary transfer control.

Figure 7:
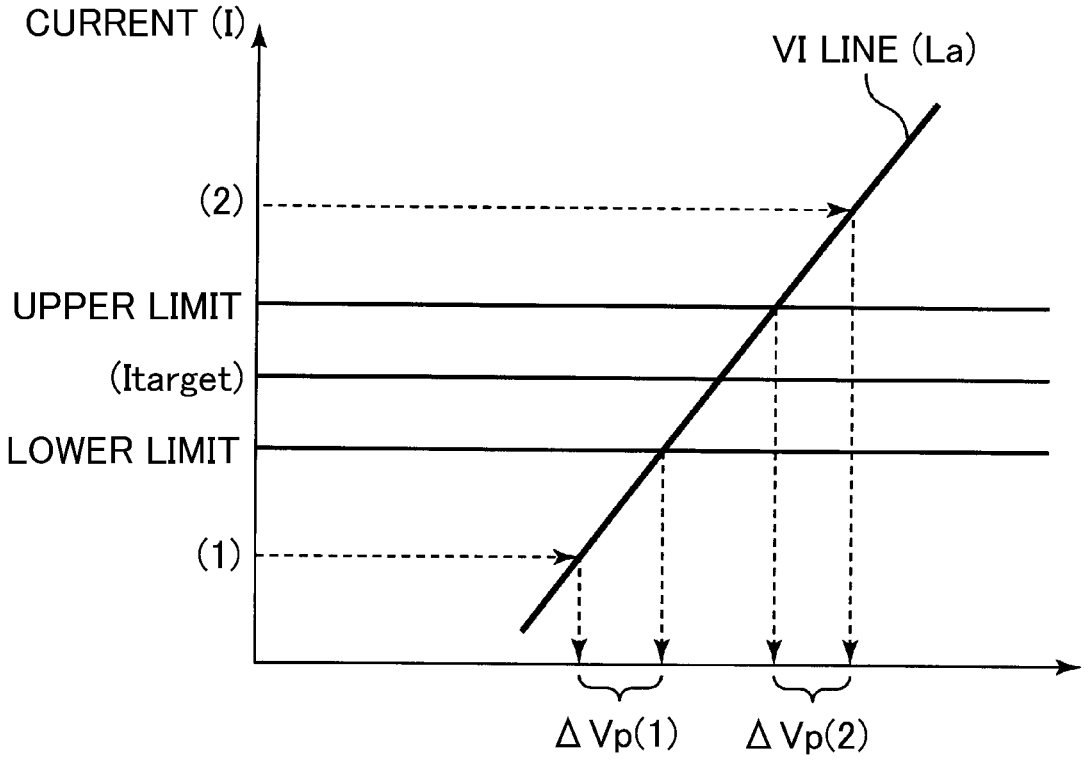

FIG. 7 is a graph for illustrating a correction voltage $\Delta Vp$ in leading end control.

Figure 8:
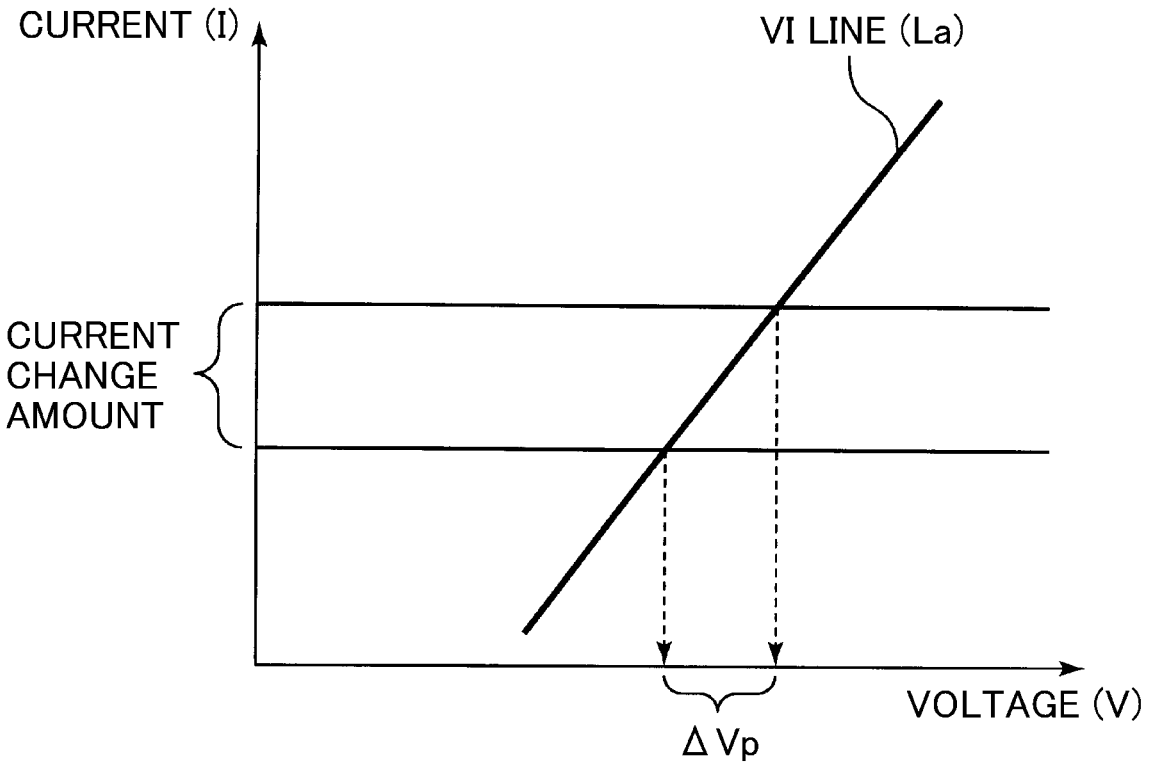

FIG. 8 is a graph for illustrating a correction voltage $\Delta Vp$ in sheet interval control.

Figure 9:
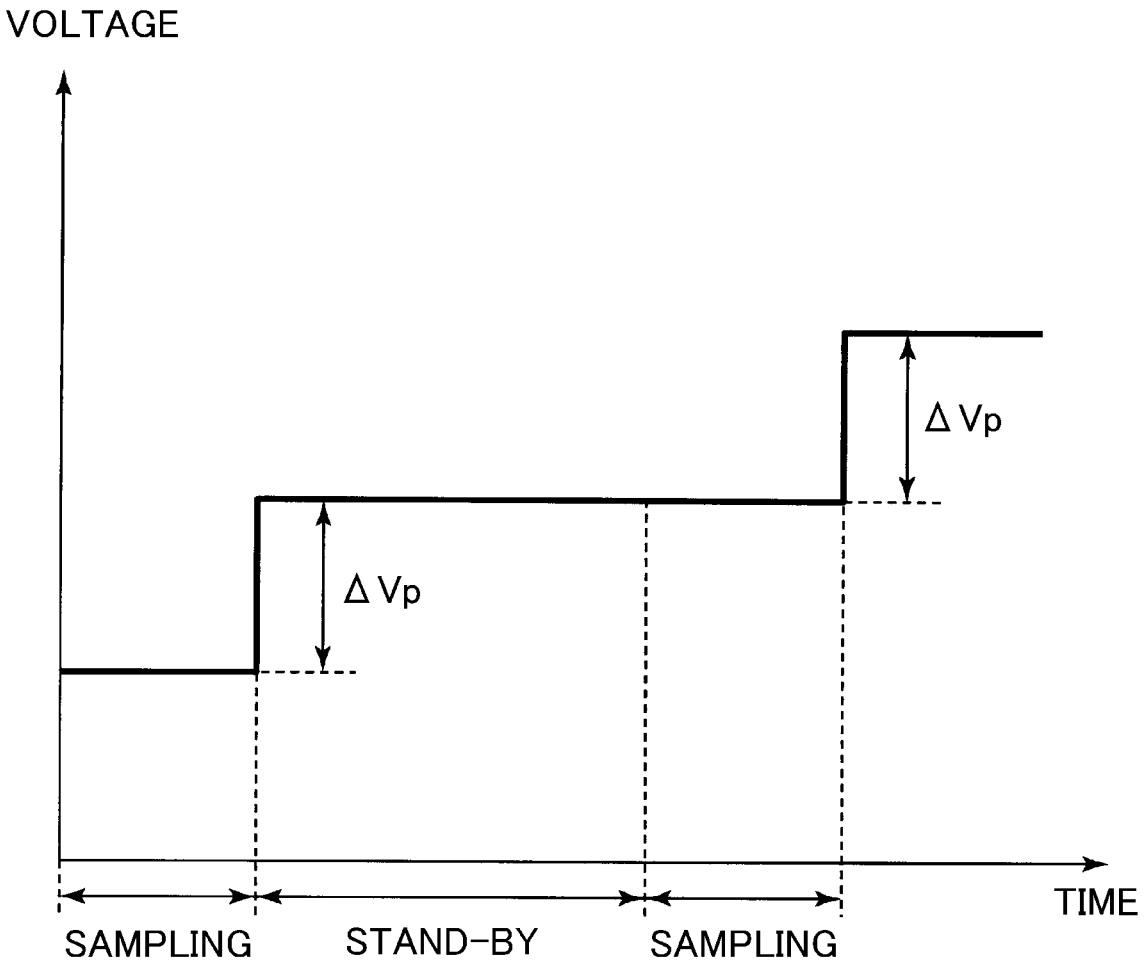

FIG. 9 is a graph for illustrating a sampling time and a stand-by time.

Figure 10:
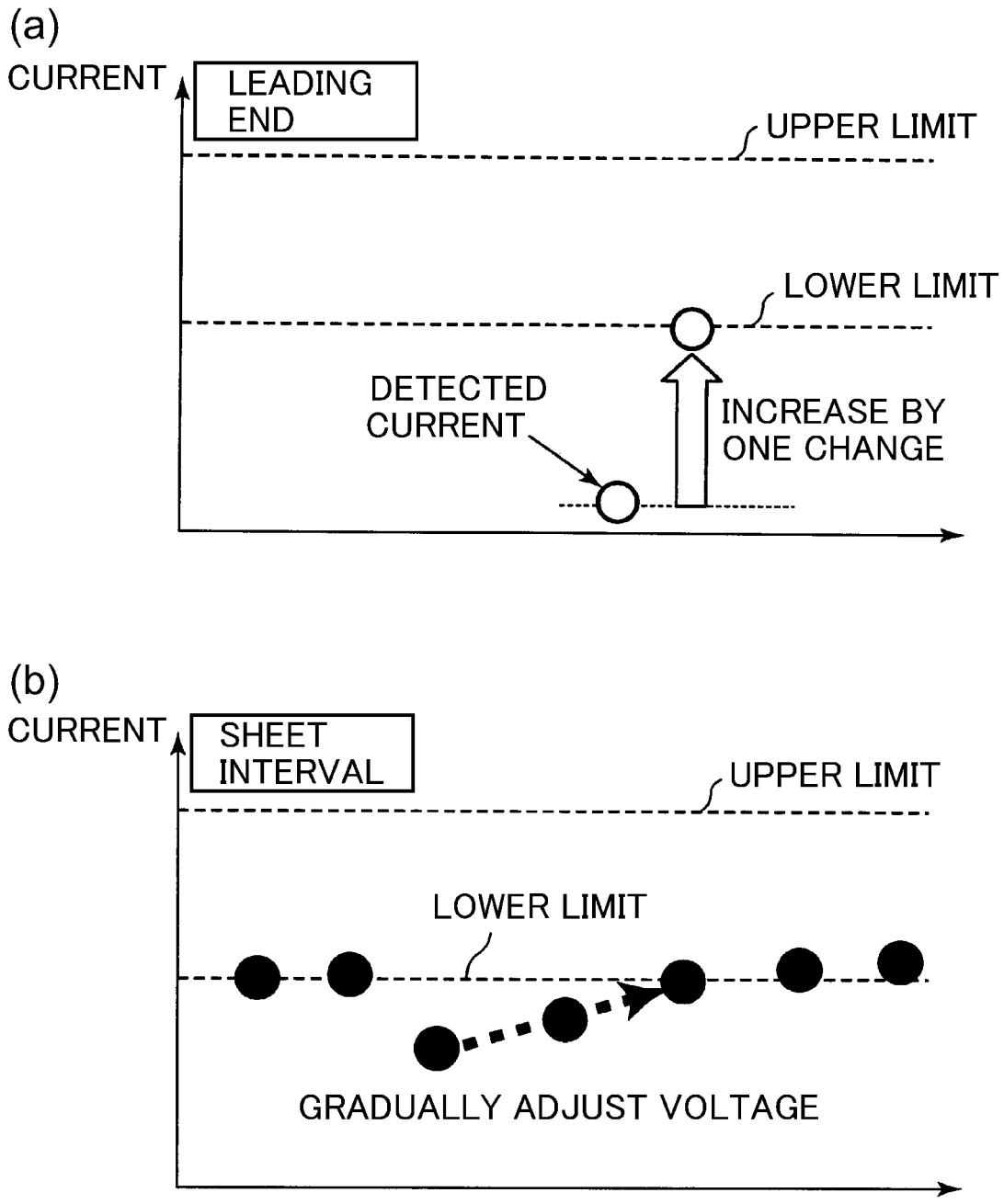

Parts (a) and (b) of FIG. 10 are graphs showing current progressions in the leading end control and the sheet interval control, respectively, in the embodiment 1.

Figure 11:
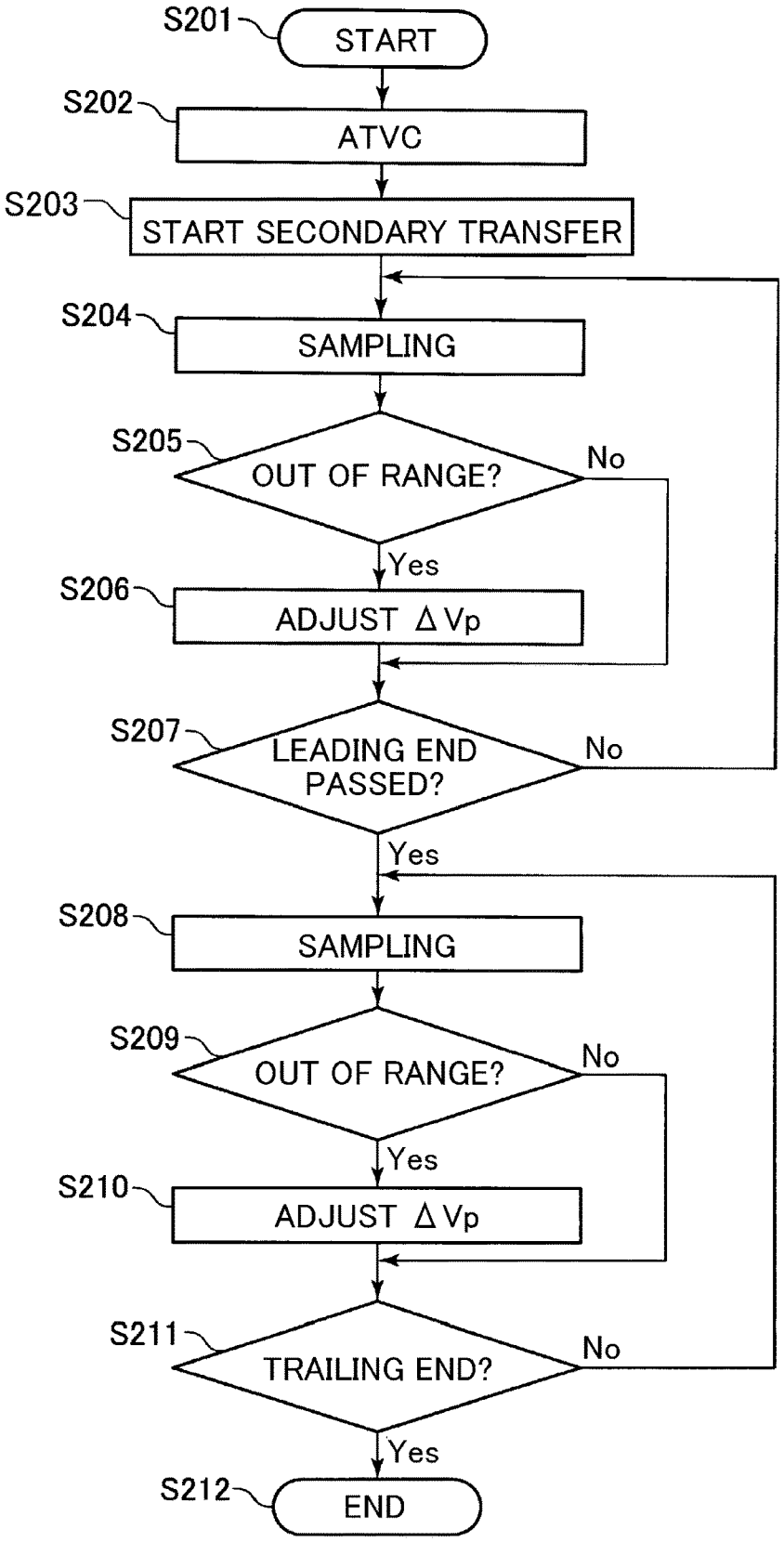

FIG. 11 is a flowchart of secondary transfer control in an embodiment 2.

Figure 12:
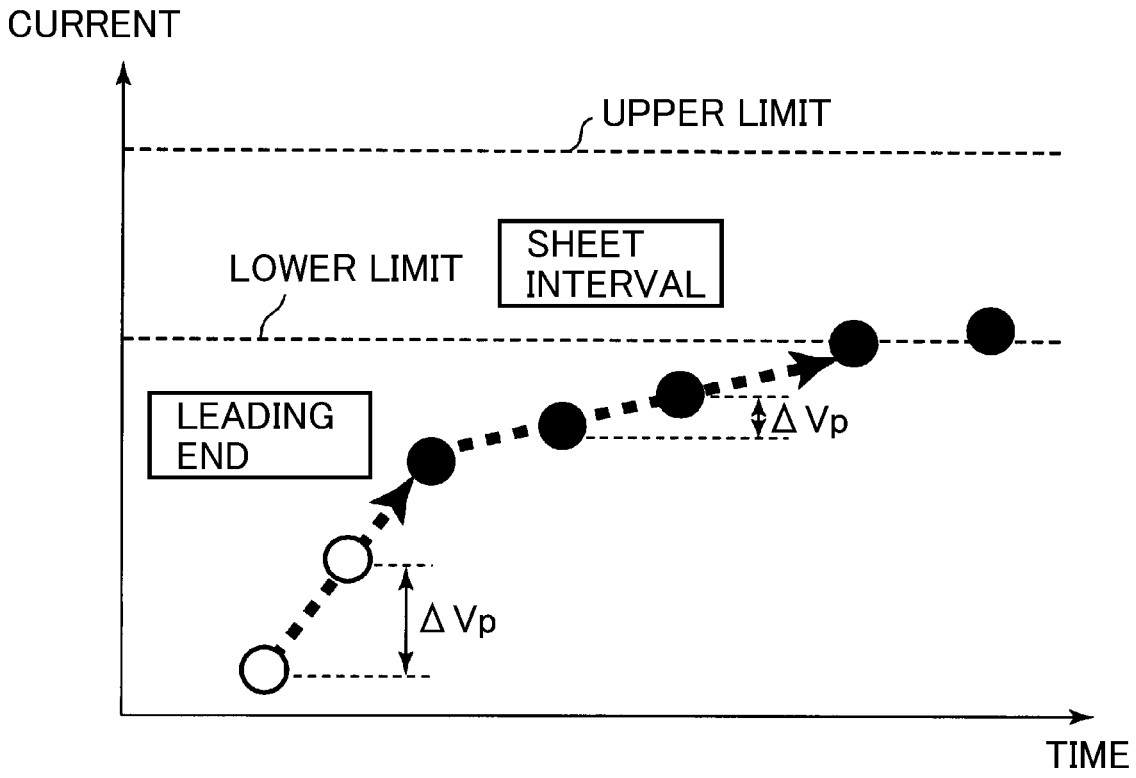

FIG. 12 is a graph showing a current progression in leading end control and sheet interval control in the embodiment 2.

Figure 13:
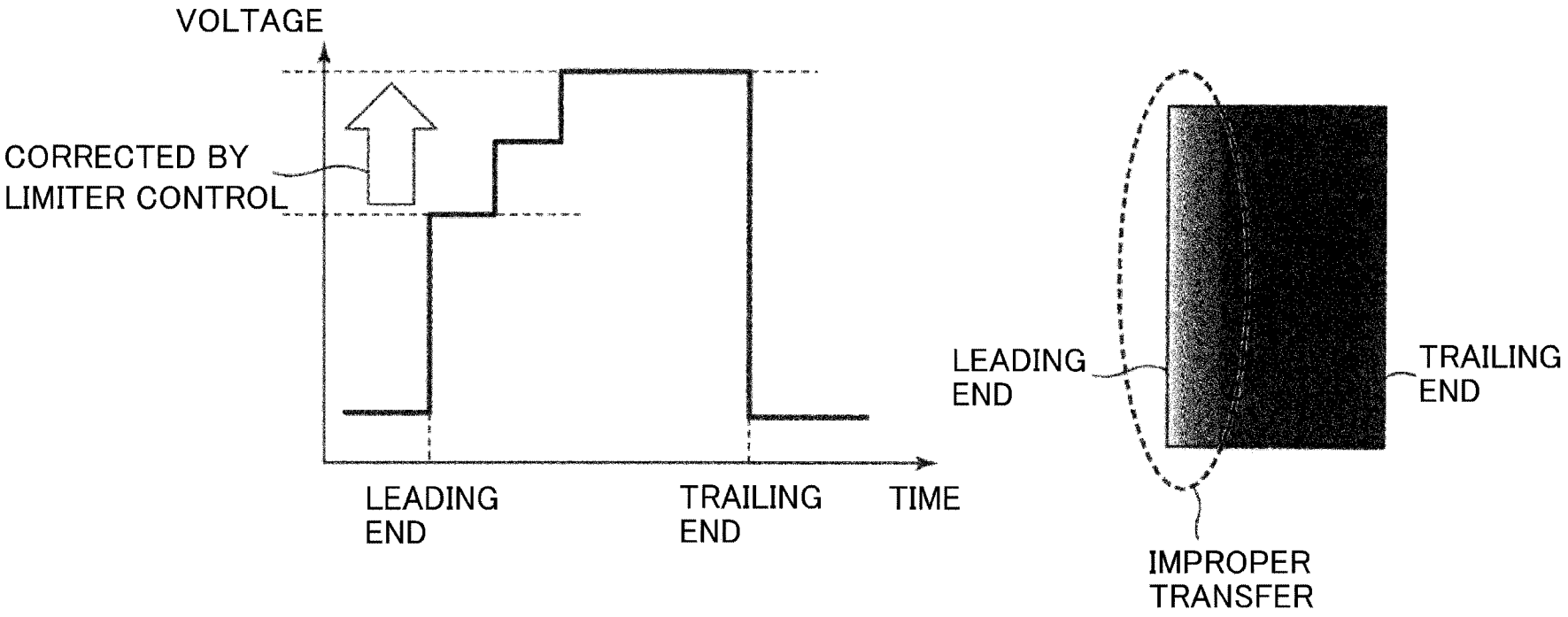

FIG. 13 is a schematic view for illustrating a problem to be solved by the present invention.

DESCRIPTION OF EMBODIMENTS

An image forming apparatus according to the present invention will be specifically described with reference to the drawings.

Embodiment 1

1. General Constitution and Operation of Image Forming Apparatus

Figure 1:
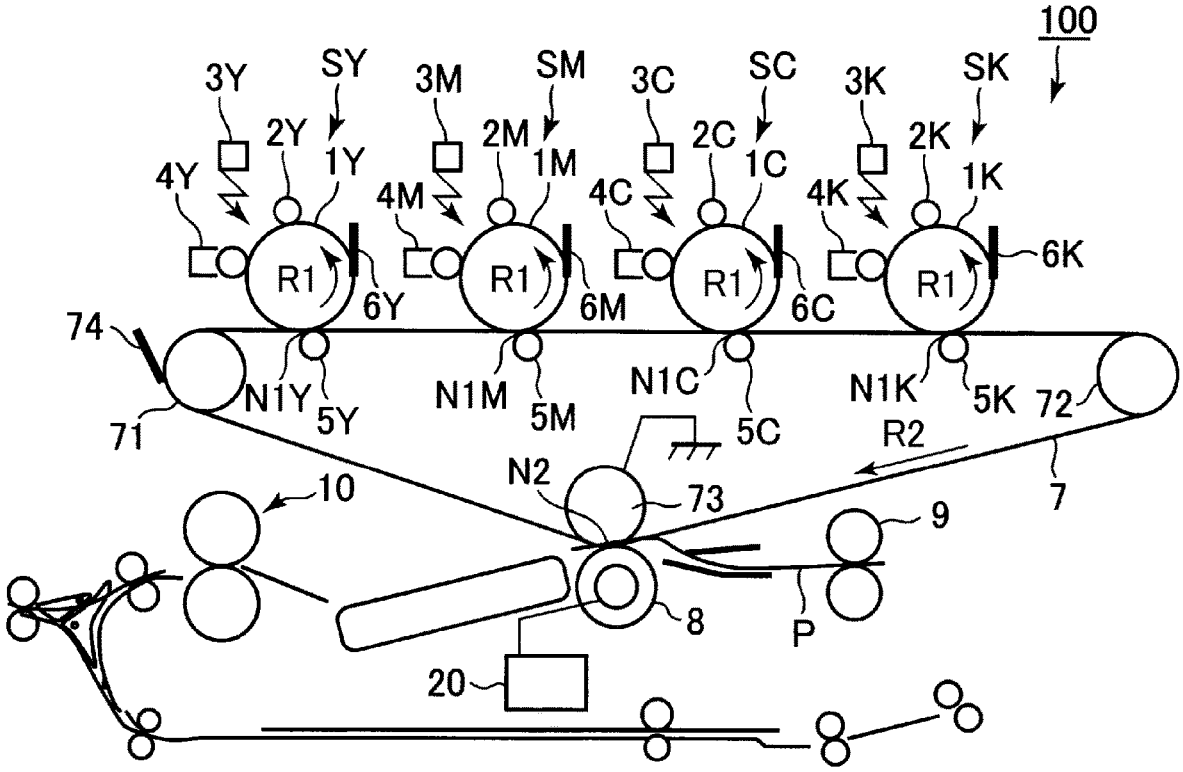
FIG. 1 is a schematic sectional view of an image forming apparatus.

FIG. 1 is a schematic sectional view of an image forming apparatus 100 of the present invention.

The image forming apparatus 100 in this embodiment is a tandem multi-function machine (having functions of a copying machine, a printer and a facsimile machines) which is capable of forming a full-color image using an electrophotographic type and which employs an intermediary transfer type.

The image forming apparatus 100 includes, as a plurality of image forming portions (stations), first to fourth image forming portions SY, SM, SC and SK for forming images of yellow (Y), magenta (M), cyan (C) and black (K). As regards elements of the respective image forming portions SY, SM, SC and SK having the same or corresponding functions or constitutions, suffixes Y, M, C and K for representing the elements for associated colors are omitted, and the elements will be collectively described in some instances. The image forming portion S is constituted by including a photosensitive drum 1, a charging roller 2, an exposure device 3, a developing device 4, a primary transfer roller 5, a drum cleaning device 6 which are described later.

The photosensitive drum 1 which is a rotatable drum-shaped (cylindrical) photosensitive member (electrophotographic photosensitive member) as a first image bearing member for bearing a toner image is rotationally driven in an arrow R1 direction (counterclockwise direction) in FIG. 1. A surface of the rotating photosensitive drum 1 is electrically charged uniformly to a predetermined polarity (negative in this embodiment) and a predetermined potential by the charging roller 2 which is a roller-type charging member as a charging means. The charged photosensitive drum 1 is subjected to scanning exposure to light by the exposure device (laser scanner device) 3 as an exposure means on the basis of image information, so that an electrostatic image (electrostatic latent image) is formed on the photosensitive drum 1.

The electrostatic image formed on the photosensitive drum 1 is developed (visualized) by supplying toner as a developer by the developing device 4 as a developing means, so that a toner image is formed on the photosensitive drum 1. In this embodiment, the toner charged to the same polarity as a charge polarity of the photosensitive drum 1 is deposited on an exposed portion (image portion) of the photosensitive drum 1 where an absolute value of the potential is lowered by exposing to light the surface of the photosensitive drum 1 after the photosensitive drum 1 is uniformly charged (reverse development type). In this embodiment, a normal charge polarity of the toner which is the charge polarity of the toner during development is a negative polarity. The electrostatic image formed by the exposure device 3 is an aggregate of small not images, and a density of the toner image to be formed on the photosensitive drum 1 can be changed by changing a density of the dot images.

As a second image bearing member for bearing the toner image, an intermediary transfer belt 7 which is an intermediary transfer member constituted by an endless belt is provided so as to be contactable to the surfaces of the four photosensitive drums 1. The intermediary transfer belt 7 is an example of an intermediary transfer member for feeding the toner image in order that the toner image primary-transferred from another image bearing member is secondary-transferred onto a recording material. The intermediary transfer belt 7 is stretched by a plurality of stretching rollers including a driving roller 71, a tension roller 72, and a secondary transfer opposite roller 73. The driving roller 71 transmits a driving force to the intermediary transfer belt 7. The tension roller 72 controls tension of the intermediary transfer belt 7 at a constant value. The secondary transfer opposite roller 73 functions as an opposing member (opposing electrode) to a secondary transfer roller 8 described later. The intermediary transfer belt 7 is rotated (circulated or moved) at a feeding speed (peripheral speed) of about 100-300 mm/sec in an arrow R2 direction (clockwise direction) in FIG. 1 by rotational drive of the driving roller 71.

To the tension roller 72, a force such that the intermediary transfer belt 7 is pushed out from an inner peripheral surface side toward an outer peripheral surface side is applied by a force of a spring as an urging means, so that by this force, tension of about 2-5 kg is exerted on the intermediary transfer belt 7 with respect to a feeding direction of the intermediary transfer belt 7. On the inner peripheral surface side of the intermediary transfer belt 7, the primary transfer rollers 5 which are roller-type primary transfer members as primary transfer means are disposed correspondingly to the respective photosensitive drums 1. The primary transfer roller 5 is urged (pressed) toward an associated photosensitive drum 1 through the intermediary transfer belt 7, whereby a primary transfer portion (primary transfer nip) N1 where the photosensitive drum 1 and the intermediary transfer belt 7 contact each other is formed.

The toner image formed on the photosensitive drum 1 electrostatic transferred primary-transferred by the action of the primary transfer roller 5 onto the rotating intermediary transfer belt 7 at the primary transfer portion Ti. During the primary transfer step, to the primary transfer roller 5, a primary transfer voltage (primary transfer bias) which is a DC voltage of an opposite polarity to a normal charge polarity of the toner is applied from an unshown primary transfer voltage source. For example, during full-color image formation, the color toner images of Y, M, C and K formed on the respective photosensitive drums 1 are successively (primary)-transferred superposedly onto the intermediary transfer belt 7.

On an outer peripheral surface side of the intermediary transfer belt 7, at a position opposing the secondary transfer opposite roller 73, the secondary transfer roller 8 which is a roller-type secondary transfer member as a secondary transfer means is provided. The secondary transfer roller 8 is urged toward the secondary transfer roller 73 through the intermediary transfer belt 7 and forms a secondary transfer portion (secondary transfer nip) N where the intermediary transfer belt 7 and the secondary transfer roller 8 contact each other. The toner images formed on the intermediary transfer belt 7 are electrostatically transferred (secondary-transferred) onto a recording material (sheet, transfer(-receiving) material) P such as paper sandwiched and fed by the intermediary transfer belt 7 and the secondary transfer roller 8 at the secondary transfer portion N2 by the action of the secondary transfer roller 8. The recording material P is typically paper (sheet), but is not limited thereto, and in some instances, synthetic paper formed of a resin material, such as waterproof paper, and a plastic sheet such as an OHP sheet, and a cloth and the like are used. During the secondary transfer step, to the secondary transfer roller 8, a secondary transfer voltage (secondary transfer bias) which is a DC voltage of the opposite polarity to the normal charge polarity of the toner is applied from a secondary transfer voltage source (high voltage source circuit) 20. The recording material P is accommodated in a recording material cassette (not shown) or the like, and is fed one by one from the recording material cassette by a feeding roller pair (not shown) or the like, and then is fed to a registration roller pair 9. This recording material P is fed toward the secondary transfer portion N2 by being timed to the toner images on the intermediary transfer belt 7 after being once stopped by the registration roller pair 9.

The recording material P on which the toner images are transferred is fed toward a fixing device 10 as a fixing means by a feeding member or the like. The fixing device 10 heats and presses the recording material P carrying thereon unfixed toner images, and thus fixes (melts) the toner images on the recording material P. Thereafter, the recording material P is discharged (outputted) to an outside of an apparatus main assembly of the image forming apparatus 100.

Further, toner (primary transfer residual toner) remaining on the surface of the photosensitive drum 1 after the primary transfer step is removed and collected from the surface of the photosensitive drum 1 by the drum cleaning device 6 as a photosensitive member cleaning means. Further, deposited matters such as toner (secondary transfer residual toner) remaining on the surface of the intermediary transfer belt 7 after the secondary transfer step, and paper powder are removed and collected from the surface of the intermediary transfer belt 7 by a belt cleaning device 74 as an intermediary transfer member cleaning means.

Here, in this embodiment, the intermediary transfer belt 7 is an endless belt made of a resin material. As a resin material, polyimide, polycarbonate or the like can be used, and as a thickness a layer of the resin material, 50-100 μm is suitable. As regards the intermediary transfer belt 7, an electric resistance is adjusted by adding an electroconductive agent for electric resistance adjustment such as carbon black into the intermediary transfer belt 7, so that volume resistivity of the intermediary transfer belt 7 may preferably be $1\times10^{9}$-$1\times10^{14}$ Ω·cm.

Further, in this embodiment, the secondary transfer roller 8 is constituted by including a core metal (base material) and an elastic layer formed with an ion-conductive foam rubber (NBR) around the core metal. In this embodiment, the secondary transfer roller 8 is 24 mm in outer diameter and 6.0-12.0 μm in surface roughness Rz. Further, in this embodiment, the electric resistance of the secondary transfer roller 8 is $1\times10^{5}$-$1\times10^{7}$Ω as measured under application of a voltage of 2 kV in an N/N (23° C./50% RH) environment. Hardness of the elastic layer is about 30-40° in terms of Asker-C hardness. Further, in this embodiment, a dimension (width) of the secondary transfer roller 8 with respect to a longitudinal direction (widthwise direction) (i.e., a length of the secondary transfer roller 8 with respect to a direction substantially perpendicular to the recording material feeding direction) is about 310-340 mm. In this embodiment, the dimension of the secondary transfer roller 8 with respect to the longitudinal direction is longer than a maximum dimension of widths (lengths with respect to the direction substantially perpendicular to the recording material feeding direction) of the recording materials for which feeding is ensured by the image forming apparatus 100. In this embodiment, the recording material P is fed on the basis of a center (line) of the secondary transfer roller 8 with respect to the longitudinal direction, and therefore, all the recording materials P for which feeding is ensured by the image forming apparatus 100 pass through within a length range of the secondary transfer roller 8 with respect to the longitudinal direction. As a result, it is possible to stably feed the recording materials P having various sizes and to stably transfer the toner images onto the recording materials P having the various sizes.

2. Control Mode

Figure 2:
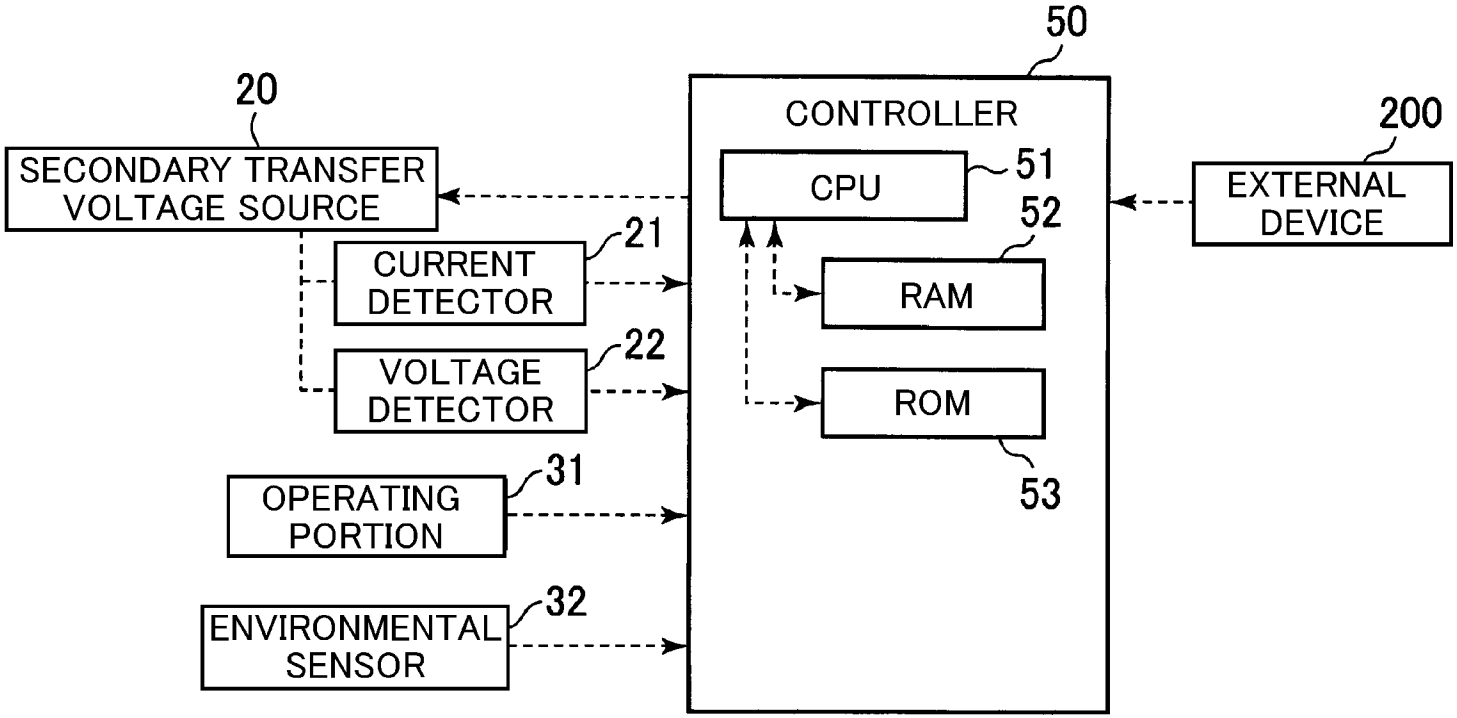
FIG. 2 is a schematic block diagram showing a control mode of a principal part of the image forming apparatus.

FIG. 2 is a schematic block diagram showing a control mode of a principal part of the image forming apparatus 100 in this embodiment. A controller (control circuit) 50 as a control means is constituted by including a CPU 51 as a calculation control means which is a dominant element for performing processing, and memories (storing media) such as a RAM 52 and a ROM 53 which are used as storing means. In the RAM 52 which is rewritable memory, information inputted to the controller 50, detected information, a calculation result and the like are stored. In the ROM 53, a data table acquired in advance and the like are stored. The CPU 51 and the memories such as the RAM 52 and the ROM 53 are capable of transferring and reading the data therebetween.

To the controller 50, the image reading device (not shown) provided to the image forming apparatus and the external device 200 such as a personal computer are connected. Further, to the controller 50, the operating portion (operating panel) 31 provided in the image forming apparatus 100 is connected. The operating portion 31 is constituted by including a display portion for displaying various pieces of information to an operator such as a user or a service person by control from the controller 50 and including an input portion for inputting various settings on the image formation and the like by the operator. The operating portion 31 may also be constituted by a touch panel or the like having a function of a display portion and a function of an inputting portion. To the controller 50, job information including a control instruction relating to image formation such as the kind of the recording material P is inputted from the operating portion 31 or an external device 200. Incidentally, the kind of the recording material P includes any information capable of discriminating the recording material P, such as attributes based on general features inclusive of plain paper, thin paper, thick paper, glossy paper, coated paper and the like, or a manufacturer, a grade, a product number, a basis weight, a thickness or the like. Incidentally, the controller 50 can acquire information on the kind of the recording material P not only by direct input of the information but also from information set in association with the cassette in advance by selecting the cassette which is the feeding portion accommodating the recording material P, for example.

Further, to the controller 50, the secondary transfer voltage source 20, a current detecting circuit 21 and a voltage detecting circuit 22 are connected. In this embodiment, the secondary transfer voltage source 20 applies, to the secondary transfer roller 8, the secondary transfer voltage which is the DC voltage subjected to the constant-voltage control. Incidentally, the constant-voltage control is control such that a value of a voltage applied to the transfer portion (i.e., the transfer member) is a substantially constant voltage value. Here, as regards the secondary transfer voltage source 20 connected to the secondary transfer roller 8, an output voltage value is variable. Further, the secondary transfer opposite roller 73 is electrically grounded (connected to the ground). The current detecting circuit as a current detecting means (current detecting portion) connected to the secondary transfer voltage source 20 detects a current (secondary transfer current) flowing through the secondary transfer portion N2 (i.e., the secondary transfer roller 8 or the secondary transfer voltage source 20). The voltage detecting circuit 22 as a voltage detecting means (voltage detecting portion) connected to the secondary transfer voltage source 20 detects a voltage (secondary transfer voltage) outputted from the secondary transfer voltage source 20. The controller 50 may also function as the voltage detecting portion and may also detect the voltage outputted from the secondary transfer voltage source 20, from an indicated value of the voltage outputted from the secondary transfer voltage source 20. In this embodiment, the secondary transfer voltage source 20, the current detecting circuit 21 and the voltage detecting circuit 22 are provided in the same high-voltage substrate. A roller corresponding to the secondary transfer opposite roller 73 in this embodiment may also be used and a secondary transfer voltage of the same polarity as a normal charge polarity of the toner is applied thereto, and a roller corresponding to the secondary transfer roller 8 in this embodiment may also be used as an opposite electrode and may also be electrically grounded. Further, to the controller 50, the environmental sensor 32 is connected. The environmental sensor 32 detects an ambient temperature and an ambient humidity in a casing of the image forming apparatus 100. Information on the temperature and the humidity which are detected by the environmental sensor 32 are inputted to the controller 50. On the basis of the temperature and humidity detected by the environmental sensor 32, the controller 50 is capable of acquiring an ambient water content (absolute water content) in the casing of the image forming apparatus 100. The environmental sensor 32 is an example of an environment detecting means for detecting at least one of the temperature and the humidity of at least one of an inside and an outside of the image forming apparatus 100. On the basis of image information from the image reading device or the external device 200 and a control instruction from the operating portion 31 or the external device 200, the controller 50 carries out integrated control of respective portions of the image forming apparatus 100 and causes the image forming apparatus 100 to execute an image forming operation.

Here, the image forming apparatus 100 executes a job (printing operation) which is a series of operations started by a single start instruction (print instruction) and in which the image is formed and outputted on a single recording material P or a plurality of recording materials P. The job includes an image forming step, a pre-rotation step, a sheet (paper) interval step in the case where the images are formed on the plurality of recording materials P, and a post-rotation step in general. The image forming step is performed in a period in which formation of an electrostatic image for the image actually formed and outputted on the recording material P, formation of the toner image, primary transfer of the toner image and secondary transfer of the toner image are carried out, in general, and during image formation (image forming period) refer to this period. Specifically, timing during the image formation is different among positions where the respective steps of the formation of the electrostatic image, the toner image formation, the primary transfer of the toner image and the secondary transfer of the toner image are performed. The pre-rotation step is performed in a period in which a preparatory operation, before the image forming step, from an input of the start instruction until the image is started to be actually formed. The sheet interval step is performed in a period corresponding to an interval between a recording material P and a subsequent recording material P when the images are continuously formed on a plurality of recording materials P (continuous image formation). The post-rotation step is performed in a period in which a post-operation (preparatory operation) after the image forming step is performed. During non-image formation (non-image formation period) is a period other than the period of the image formation (during image formation) and includes the periods of the pre-rotation step, the sheet interval step, the post-rotation step and further includes a period of a pre-multi-rotation step which is a preparatory operation during turning-on of a main switch (voltage source) of the image forming apparatus 100 or during restoration from a sleep state.

3. Secondary Transfer ATVC

The image forming apparatus 100 of this embodiment carries out ATVC (active transfer voltage control) and acquires information relating to an electric resistance of the secondary transfer portion N2. The image forming apparatus 100 of this embodiment acquires a base voltage Vb for supplying a target value (target current) Itarget of the secondary transfer current, by this ATVC. Further, the image forming apparatus 100 of this embodiment also acquires a VI rectilinear line La for acquiring a correction voltage (voltage change range) ΔVp in limiter control described later, in combination.

Figure 3:
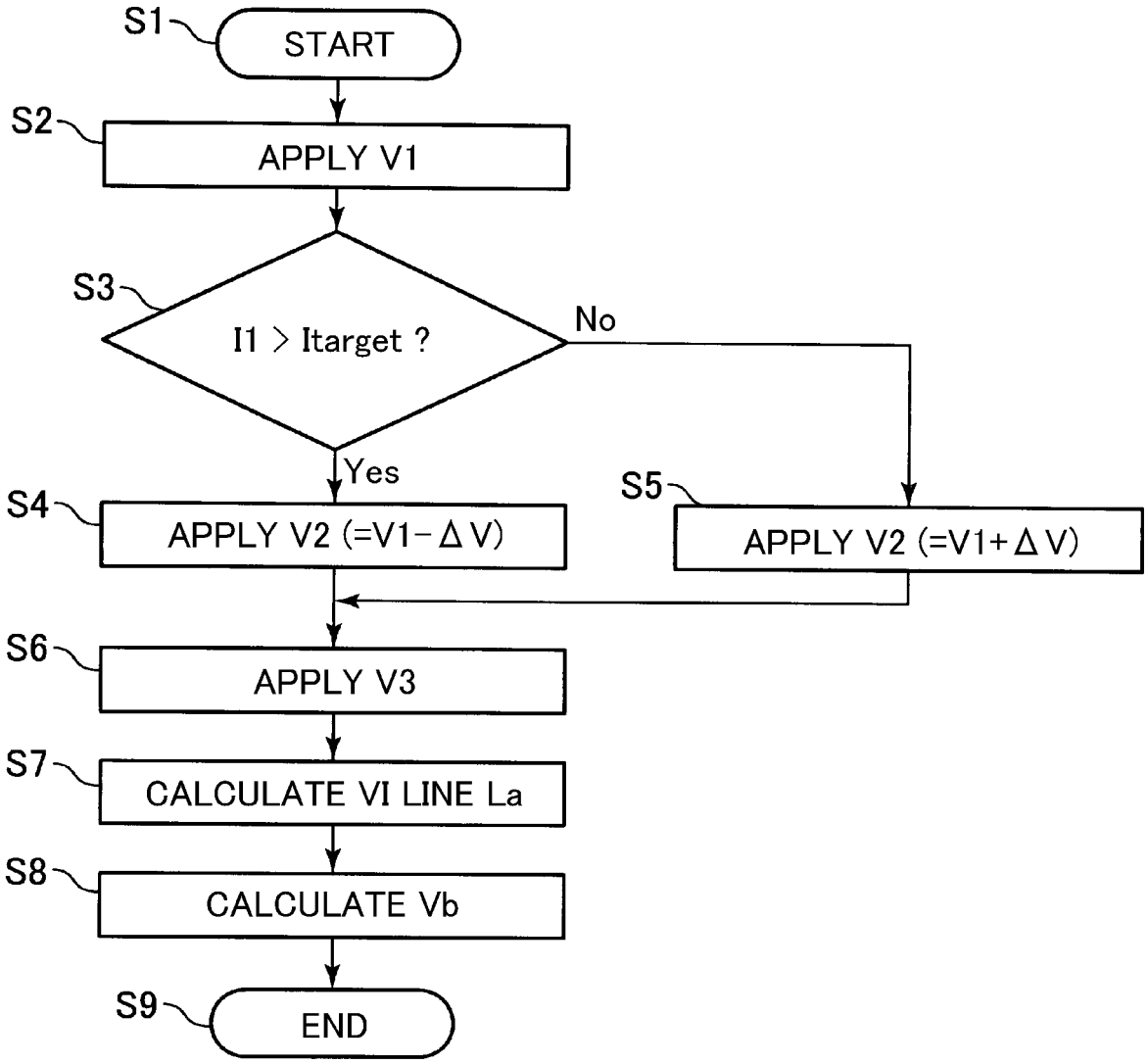
FIG. 3 is a flowchart of ATVC (active transfer voltage control).
Figure 4:
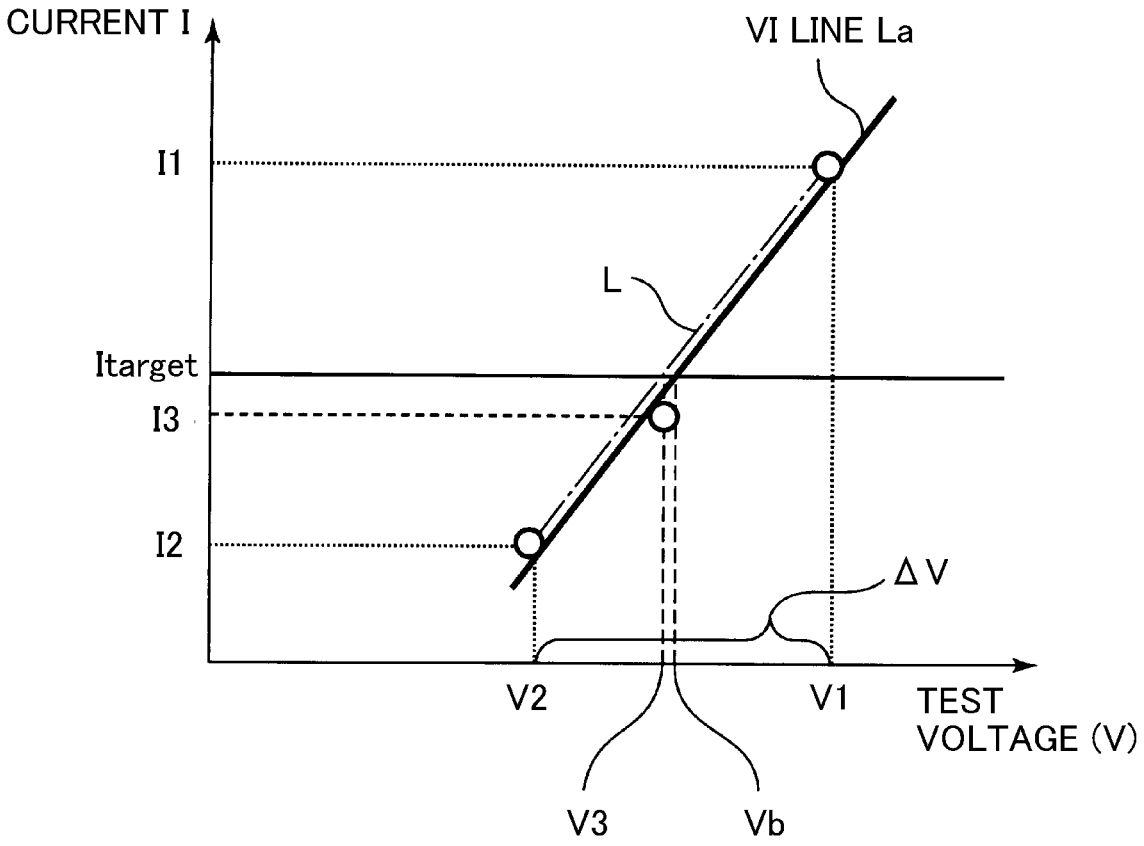
FIG. 4 is a graph for illustrating the ATVC.

FIG. 3 is a flowchart showing an outline of a procedure of the ATVC in this embodiment. Further, FIG. 4 is a graph schematically showing the VI rectilinear line La acquired in the ATVC.

The controller 50 carried out the ATVC in the pre-rotation step at timing when a start instruction (print instruction) of a job such as printing or copying is inputted from the operating portion 31 or the external device 200 depending on an operation of an operator such as a user (51). The ATVC is carried out in a state in which the toner image and the recording material P are absent at the secondary transfer portion N2 and the intermediary transfer belt 7 and the secondary transfer roller 8 are in contact with each other. When the ATVC is started and rotational drive of the intermediary transfer belt 7 is started, the controller 50 sends a signal to the secondary transfer voltage source 20, so that a first test voltage V1 applied to the secondary transfer portion N2 and the controller 50 acquires a first detected current I1 detected by the current detecting circuit 21 (S2). In the ROM 53, information relating to the first test voltage V1 is stored in advance as a table showing a relationship between an environment (temperature, humidity or water content) and a value of the first test voltage V1. On the basis of this table, the controller 50 uses the value of the first test voltage V1 depending on a detection result of the environmental sensor 32.

Then, the controller 50 discriminates whether or not the first detected current I1 is larger than the target current Itarget and determines a second test voltage V2 depending on a discrimination result thereof (S4, S5). In the ROM 53, the information on the target current Itarget is stored in advance as the table showing the relationship between the environment (water content in this embodiment) and the target current Itarget for each of kinds of the recording materials P. On the basis of this table, the controller 50 uses the information on the kind of the recording material P contained in information on the job and uses the target current Itarget depending on the detection result of the environmental sensor 32. In the case where the first detected current I1 is larger than the target current Itarget, information on a lower voltage is needed. For that reason, in this case, the controller 50 sends a signal to the secondary transfer voltage source 20, so that the second test voltage V2 obtained by subtracting a differential voltage ΔV from the first test voltage V1 is applied to the secondary transfer portion N2, and the controller 50 acquires a second detected current I2 detected by the current detecting circuit 21 (S4). On the other hand, in the case where the first detected current I1 is the target current Itarget or less, information on a higher voltage is needed. For that reason, in this case, the operator 50 sends a signal to the secondary transfer voltage source 20, so that the second test voltage V2 obtained by adding the differential voltage ΔV to the first test voltage V1 is applied to the secondary transfer portion N2, and the controller 50 acquires the second detected current I2 detected by the current detecting circuit 21 (S5). In the ROM 53, information on the differential voltage ΔV is stored in advance as the table showing the relationship between the environment (temperature, humidity or water content) and the differential voltage ΔV. On the basis of this table, the controller 50 uses the value of the differential voltage ΔV depending on the detection result of the environment sensor 32.

Then, the controller 50 acquires a voltage which is an intersection point of the target current Itarget and a rectilinear line L passing through detection results of a first point (V1, I1) and a second point (V2, I2). Then, controller 50 sends a signal to the secondary transfer voltage source 20, so that this voltage is applied as a third test voltage V3 to the secondary transfer portion N2, and the controller 50 acquires a third detected current I3 detected by the current detecting circuit 21 (S6).

Further, the controller 50 acquires the VI rectilinear line La by using the above-described three points (V1, I1), (V2, I2) and (V3, I3) and causes the RAM 52 to store the VI rectilinear line La (S7). Thereafter, on the basis of the VI rectilinear line La, the controller 50 acquires the base voltage Vb for obtaining the target current Itarget and causes the RAM 52 to store the base voltage Vp. When the controller 50 acquires the information on the base voltage Vb and the VI rectilinear line La in the above-described manner, the controller 50 ends the ATVC (S9).

As described later, an initial value of a target value for the secondary transfer voltage when the recording material P passes through the secondary transfer portion N2 is a voltage obtained by adding the base voltage Vb and a recording material part voltage Vp set in advance. The base voltage Vb corresponds to a secondary transfer portion part voltage depending on the electric resistance of the secondary transfer portion N2 (the secondary transfer roller 8 in this embodiment). The recording material part voltage Vp changes depending on the electric resistance of the recording material P, or the like, and therefore, can be set in advance depending on the kind, the environment and the like of the recording material P.

Incidentally, in this embodiment, in the ATVC, a current value when a predetermined voltage (test voltage) is supplied from the secondary transfer voltage source 20 to the secondary transfer roller 8 is detected and the relationship (V-I characteristic) between the voltage and the current was acquired, but the present invention is not limited thereto. In the ATVC, the information on the electric resistance of the secondary transfer portion may only be required to be acquired. Accordingly, a predetermined voltage (test voltage) or a predetermined current (test current) is supplied, and a voltage value when the predetermined voltage (test voltage) or the predetermined current (test current) is supplied is detected, so that the relationship (V-I characteristic)

between the voltage and the current can be acquired. Further, in this embodiment, this relationship between the voltage and the current was acquired on the basis of a detection result of 3 point (3 levels) as a plurality of levels, but may also be acquired on the basis of a smaller levels or a larger levels. This number of the levels can be appropriately selected from viewpoints that the V-I characteristic can be acquired with sufficient accuracy and that a time required for the control is not made long more than necessary, but typically, there are many cases where it is sufficient that the number of the levels is 10 levels or less.

4. Limiter Control

The image forming apparatus 100 of this embodiment executes limiter control (current limiter control), when the recording material P passes through the secondary transfer portion N2, in which the secondary transfer voltage is adjusted so that the secondary transfer current falls within a predetermined current range when the secondary transfer current is out of the predetermined current range. In this embodiment, a changeable amount per once of the secondary transfer voltage in the limiter control when a leading end portion of the recording material P with respect to the recording material feeding direction passes through the secondary transfer portion N2 is made larger than the changeable amount per once of the secondary transfer voltage in the limiter control when a central portion of the recording material P with respect to the recording material feeding direction passes through the secondary transfer portion N2. Particularly, in this embodiment, in the case where the secondary transfer current is out of the predetermined current range when the leading end portion of the recording material P with respect to the recording material feeding direction passes through the secondary transfer portion N2, by one change of the secondary transfer voltage, the secondary transfer current is caused to fall within the predetermined current range. By this, at the leading end portion of the recording material P with respect to the feeding direction, the secondary transfer current is caused to quickly converge within the predetermined current range, so that the improper transfer can be suppressed. On the other hand, at the central portion of the recording material P with respect to the feeding direction, adjustment of the secondary transfer voltage is moderately performed, so that an abrupt change of the secondary transfer current is suppressed and thus density non-uniformity can be suppressed.

Incidentally, as regards the recording material P and the image formed on the recording material P, the leading end (portion), the central portion and a trailing end (portion) refer to those with respect to the recording material feeding direction. However, in the following description, in order to avoid complication, explicit description that they relate to the recording material feeding direction will be appropriately omitted.

Here, the "leading end portion (leading end region)" of the recording material P refers to a predetermined region from the leading end (foremost end) of the recording material toward a trailing end (rearmost end) side of the recording material. A length of this predetermined region with respect to the recording material feeding direction is several mm (for example, 3 mm to 10 mm). Typically, the leading end portion of the recording material P is a "margin region" which is a non-image forming region which is out of an image forming region where the toner image is capable of being transferred and in which the toner image is not capable of being transferred. However, the leading end portion of the recording material P is not limited to a constitution consisting only of the non-image forming region but may also include the case where the image forming region is included and the case where all the region is the image forming region (in the case of marginless printing or the like). Even in the case the leading end portion of the recording material P includes the image forming region, according to this embodiment, the improper transfer can be suppressed from a position closer to the leading end of the recording material P, and therefore, a corresponding effect can be achieved.

In this embodiment, the leading end portion of the recording material p is set by a "time" such that a predetermined time has elapsed from arrival of the leading end of the recording material P at the secondary transfer portion N2. In this embodiment, the controller 50 acquires timing when the recording material P reaches the secondary transfer portion N2, from timing of sending of the recording material P from the registration roller pair 9 as the leading end detecting means, a feeding speed of the recording material P and a distance from the registration roller pair 9 to the secondary transfer portion N2. Further, in this embodiment, a period, a passing of the leading end portion of the recording material P through the secondary transfer portion N2, corresponding to a range in which leading end control described later is carried out is acquired in the following manner. That is, a time from arrival of the leading end of the recording material P at the secondary transfer portion N2 until the predetermined region (typically, the margin region) of the recording material P completely passes through the secondary transfer portion N2 is acquired from the feeding speed of the recording material P.

Incidentally, the leading end of the recording material P can also be detected by the following method. That is, when current detection by the current detecting circuit 21 is started by applying the secondary transfer voltage from before the recording material P reaches the secondary transfer portion N2, in general, the recording material P reaches the secondary transfer portion N2, so that the secondary transfer current abruptly becomes small. The leading end of the recording material P is detected on the basis of the change of the secondary transfer current, and from a detection result thereof and the feeding speed of the recording material P, the period in which the leading end portion of the recording material P passes through the secondary transfer portion N2 can be acquired. Further, the leading end portion of the recording material P can be set by "the number of times of sampling" which corresponds to a period from the arrival of the leading end of the recording material P at the secondary transfer portion N2 until sampling of the leading end portion of the recording material is carried out a predetermined number of times (for example, one time to three times).

Further, the "central portion (central region)" of the recording material P represents a region other than the leading end portion of the recording material P with respect to the recording material feeding direction in comparison with the leading end portion of the recording material P, and there is no need that the central portion is not required to be a strict central portion with respect to the recording material feeding direction. In this embodiment, the central portion of the recording material P represents an entire region of the recording material P other than the leading end portion of the recording material P with respect to the recording material feeding direction. The central portion of the recording to material P is an image forming region in general.

Figure 5:
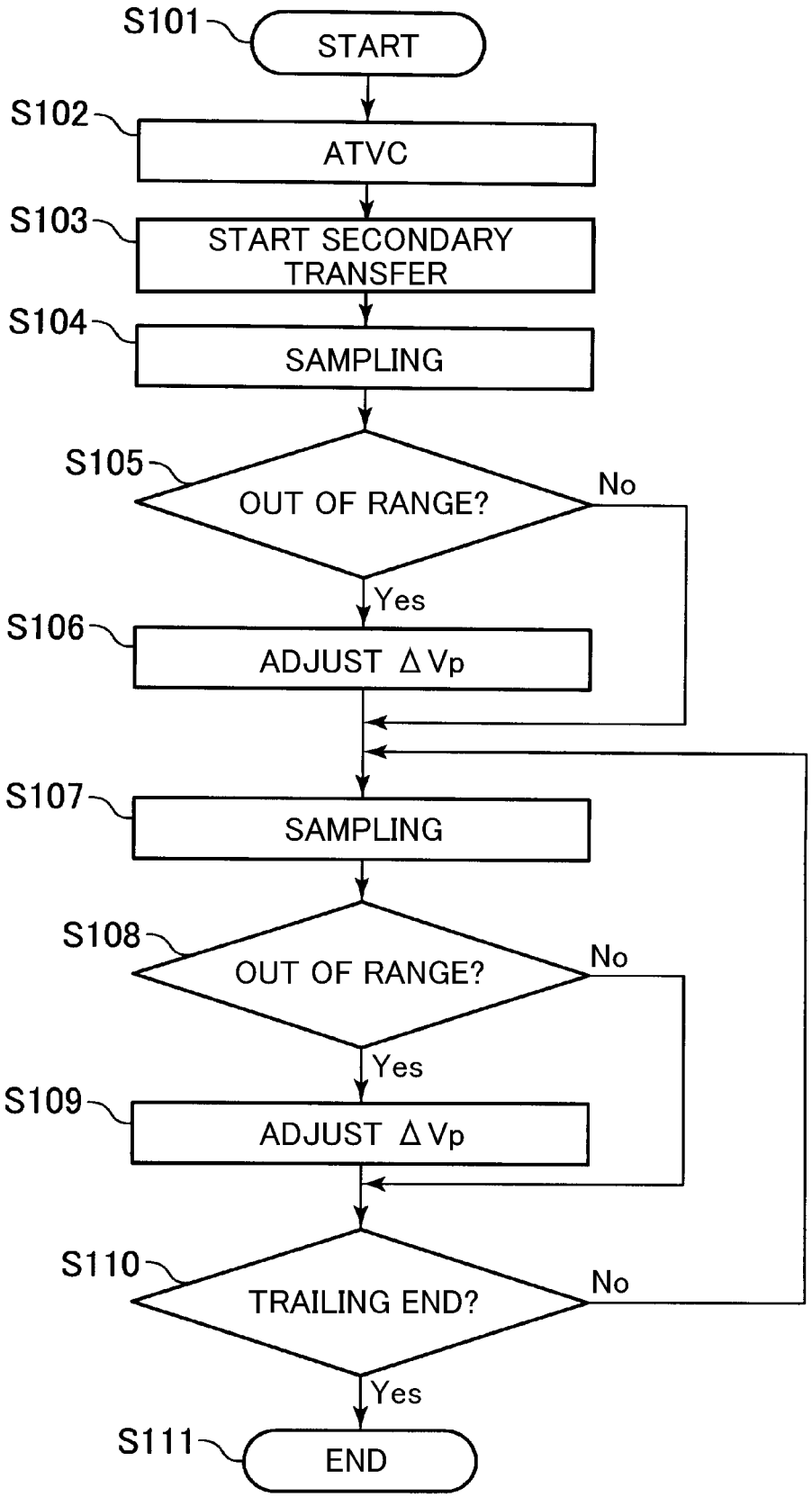
FIG. 5 is a flowchart of secondary transfer control in an embodiment 1.

FIG. 5 is a flowchart showing an outline of a procedure of secondary transfer control including the ATVC and the limiter control during execution of a job in this embodiment.

FIG. 5 shows, as an example, the case where the job for forming an image on a single recording material P is executed.

The controller 50 causes the image forming apparatus to start an operation of the job by inputting thereto a start instruction (print instruction) of the job such as printing or copying from the operating portion 31 or the external device 200 depending on an operation by the operator such as the user (S101). Then, the controller 50 carries out the ATVC and causes the RAM 52 to store information on the base voltage Vb and the VI rectilinear line L1 (S102). During executing of the ATVC at the secondary transfer portion N2, depending on the job information inputted from the operating portion 31 or the external device 200 to the controller 50 by the operator such as the user, the controller 50 causes the image forming apparatus to successively carry out the charging, the light exposure, the development and the primary transfer as described above in order to output a designated image. Incidentally, the job information includes the job start instruction, image information, and control instructions (kind (size, basis weight or the like), the number of sheets subjected to image formation, and the like). Then, when the recording material P is carried to the secondary transfer portion N2 by being timed to the toner image on the intermediary transfer belt 7, in synchronism with the timing, the controller 50 starts application of the secondary transfer voltage from the secondary transfer voltage source 20 to the secondary transfer portion N2 (S103). A secondary transfer voltage Vtr first applied by the secondary transfer voltage source 20 when the recording material P enters the secondary transfer portion N2 is a value obtained by adding the recording material part voltage Vp to the base voltage Vb. In the ROM 53, information on the recording material part voltage Vp is stored in advance as a table showing a relationship between an environment (water content in this embodiment) and the recording material part voltage Vp every kind (basis weight in this embodiment) of the recording material P as shown in part (b) of FIG. 6, for example. On the basis of this table, the controller 50 uses a value of the recording material part voltage Vp depending on the information on the kind of the recording material P contained in the job information and a detection result of the environmental sensor 32.

Then, the controller 50 executes the limiter control for the leading end portion of the recording material P when the leading end portion of the recording material P passes through the secondary transfer portion N2 (herein, this control is also referred to as "leading end control"). First, the controller 50 carries out sampling of the secondary transfer current for a certain time by the current detecting circuit 21 and averages detected current sampled (S104). In this embodiment, a sampling time in this case is about 10 ms. The controller 50 discriminates whether or not the averaged detected current is out of a predetermined current range (a lower limit current value or more and an upper limit current value or less) (S105). In the ROM 53, information on this predetermined current range (the upper limit current value and the lower limit current value) is stored as a table showing a relationship between the environment (water content in this embodiment) and the predetermined current range (the upper limit current value and the lower limit current value) every kind (basis weight in this embodiment) of the recording material P as shown in part (a) of FIG. 6, for example. On the basis of this table, the controller 50 uses a value of the predetermined current range (the upper limit current value and the lower limit current value) depending on the information on the kind of the recording material P contained in the job information and the detection result of the environmental sensor 32.

In the case where the controller 50 discriminated in S105 that the detected current is out of the predetermined current range, the controller 50 acquires the correction voltage ΔVp and adjusts a present secondary transfer voltage Vtr by adding or subtracting this correction voltage ΔVp (S106). In this leading end control, in order to cause the secondary transfer current to quickly converge within the predetermined current range to the extent possible, the environment ΔVp is acquired in the following manner. FIG. 7 is a graph for illustrating a method of acquiring the correction voltage ΔVp in the leading end control. In the case where the detected current is smaller than the lower limit current value (the case of detected current (1)), the controller 50 compares the detected current with the lower limit current and acquires a correction voltage ΔVp(1) corresponding to a difference (current difference) therebetween. At this time, the controller 50 uses a slope of the VI rectilinear line La stored in the RAM 52 and acquired by the ATVC described above. That is, the controller 50 acquires the correction voltage ΔVp(1) capable of eliminating the current difference between the detected current and the lower limit current value depending on information on the electric resistance of the secondary transfer portion N2 acquired by the ATVC. Then, the controller 50 changes the target voltage to a new target voltage Vtr (=Vb+Vp+ΔVp) by adding the acquired correction voltage ΔVp to a target voltage Vtr (=Vb+Vp) of the present secondary transfer voltage. On the other hand, in the case where the detected current is larger than the lower limit current value (the case of detected current (2)), the controller 50 compares the detected current with the upper limit current and acquires a correction voltage ΔVp(2) corresponding to a difference (current difference) therebetween. At this time, similar to the above-described case, the controller 50 uses a slope of the VI rectilinear line La stored in the RAM 52 and acquired by the ATVC described above. That is, the controller 50 acquires the correction voltage ΔVp(2) capable of eliminating the current difference between the detected current and the upper limit current value depending on information on the electric resistance of the secondary transfer portion N2 acquired by the ATVC. Then, the controller 50 changes the target voltage to a new target voltage Vtr (=Vb+Vp−ΔVp) by subtracting the acquired correction voltage ΔVp from a target voltage Vtr (=Vb+Vp) of the present secondary transfer voltage. By this, the secondary transfer current can be corrected to the neighborhood of the predetermined current range by one change of the secondary transfer voltage. That is, typically, the secondary transfer current can be corrected by the one change of the secondary transfer voltage to the lower limit current value in the case where the secondary transfer current falls below the lower limit current value and to the upper limit current value in the case where the secondary transfer current falls above the upper limit current value. The controller 50 adds the acquired correction voltage ΔVp to the table value of the recording material part voltage Vp used at present, and then causes the RAM 52 to store the resultant value. Then, when the secondary transfer voltage Vtr is corrected after subsequent sampling of the secondary transfer current, the controller 50 uses, as the recording material part voltage Vp, a value obtained by adding the last sampled correction voltage ΔVp to the table value of the recording material part voltage Vp. That is, the correction voltage ΔVp is cumulatively increased every time when the correction voltage ΔVp is acquired by the limiter control in a manner such that the correction voltage ΔVp is added to the recording material part voltage Vp after the subsequent sampling of the secondary transfer current. Further, in the case where the controller 50 discriminated in S105 that the detected current falls within the predetermined current range, the sequence goes to a process of S107 without making the change of the secondary transfer voltage on the basis of a sampling result at the leading end portion of the recording material P (i.e., the secondary transfer voltage is maintained at a present value).

In this embodiment, by using the correction voltage ΔV corresponding to the current difference between the detected current and the lower limit current value or the upper limit current value, the secondary transfer current is corrected typically to the lower limit current value or the upper limit current value, but the present invention is not limited thereto. For example, a voltage larger than a voltage enough to eliminate the above-described current difference may also be used as the correction voltage ΔVp so that the state falls within the predetermined current range with reliability. In this case, for example, it may only be required that the correction voltage ΔVp corresponding to the current difference between the detected current and a value between the lower limit current value and the upper limit current value is acquired. Further, when the secondary transfer current can be sufficiently corrected to the neighborhood of the predetermined current range, due to a control error or the like, the secondary transfer current supplied by the secondary transfer voltage after the correction may also be out of the predetermined current range, in a sufficiently small range. However, a changeable amount of the secondary transfer voltage per once (of the change) in the leading end control is made larger than a changeable amount of the secondary transfer voltage per once (of the change) in sheet interval control described later.

Then, the controller 50 executes limiter control for a region (other than the leading end portion) on a trailing end side than the leading end portion of the recording material P with respect to the recording material feeding direction (herein, this control is also referred to as the "sheet interval control"). In this embodiment, the leading end portion of the recording material P was a region of a length (time) with respect to the recording material feeding direction in which one sampling of the secondary transfer current (and subsequent one change of the secondary transfer voltage if necessary) is capable of being performed after the recording material P reaches the secondary transfer portion N2. Accordingly, the sheet interval control is carried out from second sampling of the secondary transfer current after the leading end of the recording material P reaches the secondary transfer portion N2. Also in the sheet interval control, similarly as in the leading end control, the controller 50 performs the sampling of the secondary transfer current for a certain time by the current detecting circuit 21 and then averages the sampled detected currents (S107). In this embodiment, a sampling time in this case is about 10 ms similarly as in the leading end control. However, for example, for the purpose of alleviating a calculation load at the controller 50, a longer sampling time may also be employed. The controller 50 discriminates whether or not the averaged detected current is out of a predetermined current range (the lower limit current value or more and the upper limit current value or less) (S108). The predetermined current value in this case may be a table value stored in the ROM 53 similarly as in the leading end control.

In the case where the controller 50 discriminated in S108 that the detected current is out of the predetermined current range, the controller 50 acquires the correction voltage ΔVp and adjusts the present secondary transfer voltage Vtr by adding or subtracting this correction voltage ΔVp (S109). In the sheet interval control, in order to suppress the density non-uniformity, the correction voltage ΔVp is acquired in the following manner. FIG. 8 is a graph for illustrating a method of acquiring the correction voltage ΔVp in the sheet interval control. In this embodiment, in order to suppress the density non-uniformity, whether or not how many degree (what pA) is proper as a secondary transfer current change amount per unit feeding distance of the recording material P is acquired advance by an experiment or the like. Then, the correction voltage ΔVp which is the change amount of the secondary transfer voltage per once (of the change) in the sheet interval control is set at a change amount of the secondary transfer voltage corresponding to a secondary transfer current change amount per unit feeding distance (unit length with respect to a process progression direction) of the recording material P. In this embodiment, the secondary transfer current change amount per unit feeding distance of the recording material P is set at about 0.3 μA/mm. For example, in the case where the feeding speed of the recording material P is 200 mm/sec and the sampling time is 10 ms, the secondary transfer current change amount by one change of the secondary transfer voltage is 0.6 μA from the following formula: 0.3 (μA/mm)×200 (mm/sec)×10 (ms)=0.6 μA. This information on the secondary transfer current change amount is stored in advance in the ROM 53. Then, the controller 50 acquires the correction voltage ΔVp which is the secondary transfer voltage change amount per once (of the change) from the above-described secondary transfer current change amount by using the slope of the VI (rectilinear line La acquired by the above-described ATVC stored in the RAM 52 as shown in FIG. 8. That is, depending on the information on the electric resistance of the secondary transfer portion N2 acquired by the ATVC, the controller 50 acquires the correction voltage ΔVp which is the secondary transfer voltage change amount corresponding to a predetermined secondary transfer current change amount. By this, in the region other than the leading end portion of the recording material P, it becomes possible to suppress the density non-uniformity by moderately adjusting the secondary transfer voltage. Incidentally, in the case where ΔVp is corrected, some time lag arises in a change of output of the secondary transfer voltage source 20. Further, after the change of ΔVp, there is a need to take a time until the current is in a steady state in some cases. For that reason, in this embodiment, as shown in FIG. 9, a stand-by time is provided in a period until subsequent sampling is performed. This stand-by time can be appropriately set depending on a performance of the high voltage source or the like, but was set at about 20 ms in this embodiment.

Thereafter, the controller 50 repetitively executes the sheet interval control until the trailing end of the recording material P reaches the secondary transfer portion N2 (S110). Then, the controller 50 ends the secondary transfer control when the trailing end of the recording material P reaches the secondary transfer portion N2 (S111). Further, in the case where the controller 50 discriminates in S108 that the detected current falls within the predetermined current range, the controller 50 causes the sequence to go to a process of S110 without carrying out the secondary transfer voltage change on the basis of the present sampling result (that is, the secondary transfer voltage is kept at the present value).

Parts (a) and (b) of FIG. 10 are graphs schematically showing examples of progressions of detected currents in the leading end control and the sheet interval control, respectively. Each of parts (a) and (b) of FIG. 10 shows the example of the case where the electric resistances of the leading end portion and the central portion of the recording material P were high and the secondary transfer current fell below the lower limit current value of the predetermined current range. In this embodiment, in the leading end control, in the case where detection that the secondary transfer current fell below the lower limit current value was made, the secondary transfer current is increased up to the lower limit current value by one change of the secondary transfer voltage. On the other hand, in the sheet interval control, in the case where detection that the secondary transfer current fell below the lower limit current value was made, the secondary transfer current is gradually increased toward the lower limit current value by gradually increasing the secondary transfer voltage. By this, in the leading end control, the secondary transfer current is caused to quickly fall within the predetermined current range to the extent possible, so that improper transfer at the leading end portion of the recording material P can be suppressed. On the other hand, in the sheet interval control, an abrupt change in secondary transfer current is suppressed, so that the density non-uniformity at the central portion of the recording material P can be suppressed.

Thus, in this embodiment, the image forming apparatus 100 includes the controller 50 for carrying out the constant-voltage control so that the voltage applied to the transfer member 8 becomes the predetermined voltage when the recording material P passes through the transfer portion N2. This controller 50 controls the voltage applied to the transfer member 8, on the basis of a detection result of the current detecting portion 21 so that the detection result of the current detecting portion 21 falls within a predetermined range. Further, the voltage changeable amount per once in the control of the voltage applied to the transfer member 8 on the basis of the detection result of the current detecting portion 21 when the leading end portion of the recording material P with respect to the recording material feeding direction passes through the transfer portion N2 is larger than the voltage changeable amount per once in the control of the voltage applied to the transfer member 8 on the basis of the detection result of the current detecting portion 21 when the central portion of the recording material P with respect to the recording material feeding direction passes through the transfer portion. In this embodiment, in the control of the voltage applied to the transfer member 8 on the basis of the detection result of the current detecting portion 21 when the leading end portion of the recording material P with respect to the recording material feeding direction passes through the transfer portion N2, the controller 50 changes the voltage applied to the transfer member 8 so that the difference between the above-described predetermined current range and the current indicated by the detection result of the current detecting portion 21 is a predetermined voltage or less (this predetermined value may also be zero). On the other hand, in this embodiment, in the control of the voltage applied to the transfer member 8 on the basis of the detection result of the current detecting portion 21 when the central portion of the recording material P with respect to the recording material feeding direction passes through the transfer portion N2, the controller 50 changes the voltage applied to the transfer member 8 every predetermined change range. Further, in this embodiment, on the basis of the V-I characteristic acquired by applying the voltage to the transfer member 8 in a state in which the recording material P is absent at the transfer portion N2, the controller 50 sets the voltage change amount per once in the control of the voltage applied to the transfer member 8 on the basis of the detection result of the current detecting portion 21. Further, in this embodiment, the leading end portion is the margin region where the toner image is not transferred on the leading end side of the recording material P with respect to the feeding direction.

As described above, according to this embodiment, in the constitution in which the limiter control is carried out, it is possible to suppress the density non-uniformity in the neighborhood of the central portion of the recording material P with respect to the recording material feeding direction while suppressing the improper transfer at the leading end portion with respect to the recording material feeding direction.

Embodiment 2

Next, another embodiment of the present invention will be described. Basic constitution and operation of an image forming apparatus of this embodiment are the same as those of the image forming apparatus of the embodiment 1. Accordingly, in the image forming apparatus of this embodiment, elements having identical or corresponding functions or structures to those of the image forming apparatus of the embodiment 1 are represented by the same reference numerals or symbols and will be omitted from detailed description.

In the leading end control in the embodiment 1, the secondary transfer current was caused to fall within the predetermined current range by one change of the secondary transfer voltage. On the other hand, in this embodiment, also in the leading end control, similarly as in the sheet interval control in the embodiment 1, the correction voltage $\Delta Vp$ in one change of the secondary transfer voltage is limited. However, the secondary transfer voltage change amount per once in the leading end control is made larger than the secondary transfer voltage change amount per one in the sheet interval control. In this embodiment, the secondary transfer current change amount per unit feeding distance of the recording material P is set at about 3 μA/mm in the leading end control and at about 0.3 μA/mm in the sheet interval control. Further, in this embodiment, the correction voltage (voltage change range) $\Delta Vp$ which is the secondary transfer voltage change amount per once in each of the leading end control and the sheet interval control is a secondary transfer voltage change amount corresponding to this secondary transfer current change amount.

FIG. 11 is a flowchart showing an outline of a procedure of secondary transfer control including the ATVC and the limiter control during execution of a job in this embodiment. FIG. 11 shows, as an example, the case where the job for forming an image on a single recording material P is executed.

The controller 50 causes the image forming apparatus to start an operation of the job by inputting thereto a start instruction (print instruction) of the job such as printing or copying from the operating portion 31 or the external device 200 depending on an operation by the operator such as the user (S201). Then, the controller 50 carries out the ATVC and causes the RAM 52 to store information on the base voltage Vb and the VI rectilinear line L1 (S202). During executing of the ATVC at the secondary transfer portion N2, depending on the job information inputted from the operating portion 31 or the external device 200 to the controller 50 by the operator such as the user, the controller 50 causes the image forming apparatus to successively carry out the charging, the light exposure, the development and the primary transfer as described above in order to output a designated image. Incidentally, the job information includes the job start instruction, image information, and control instructions (kind (size, basis weight or the like), the number of sheets subjected to image formation, and the like). Then, when the recording material P is carried to the secondary transfer portion N2 by being timed to the toner image on the intermediary transfer belt 7, in synchronism with the timing, the controller 50 starts application of the secondary transfer voltage from the secondary transfer voltage source 20 to the secondary transfer portion N2 (S203). A secondary transfer voltage Vtr first applied by the secondary transfer voltage source 20 when the recording material P enters the secondary transfer portion N2 is a value obtained by adding the table value of the recording material part voltage Vp stored in the ROM 53 to the base voltage Vb similarly as in the embodiment 1.

Then, the controller 50 executes the limiter control (leading end control) for the leading end portion of the recording material P when the leading end portion of the recording material P passes through the secondary transfer portion N2. First, the controller 50 carries out sampling of the secondary transfer current for a certain time by the current detecting circuit 21 and averages detected current sampled (S204). In this embodiment, a sampling time in this case is about 10 ms. The controller 50 discriminates whether or not the averaged detected current is out of a predetermined current range (a lower limit current value or more and an upper limit current value or less) (S205). In this case, the predetermined current range may also be the table value stored in the ROM 53 similarly as in the embodiment 1.

In the case where the controller 50 discriminated in S205 that the detected current is out of the predetermined current range, the controller 50 acquires the correction voltage ΔVp and adjusts a present secondary transfer voltage Vtr by adding or subtracting this correction voltage ΔVp (S206). In the leading end control in this embodiment, the correction voltage ΔVp is acquired similarly as in the sheet interval control in the embodiment 1. However, in the leading end control in this embodiment, the correction voltage ΔVp which is the change amount of the secondary transfer voltage per once (of the change) is a change amount of the secondary transfer voltage corresponding to about 3 μA/mm which is a secondary transfer current change amount per unit feeding distance of the recording material P. This change amount of the secondary transfer voltage is a larger value than a correction voltage ΔVp (corresponding to about 0.3 μA/mm which is the secondary transfer current change amount per unit feeding distance of the recording material P) which is a secondary transfer voltage change adjusting mode per once in the sheet interval control described later. By this, in the leading end control, it is possible to cause the secondary transfer current to converge within the predetermined current range more quickly than the sheet interval control. Incidentally, in the case where ΔVp is corrected, some time lag arises in a change of output of the secondary transfer voltage source 20. For that reason, in this embodiment, as shown in FIG. 9, a stand-by time is provided in a period until subsequent sampling is performed. This stand-by time can be appropriately set depending on a performance of the high voltage source or the like, but was set at about 20 ms in this embodiment.

Thereafter, the controller 50 repetitively executes the leading end control until a predetermined trailing end of the leading end portion of the recording material P reaches the secondary transfer portion N2 (S207). Similarly as in the embodiment 1, the correction voltage ΔVp is cumulatively increased every time when the correction voltage ΔVp is acquired by the limiter control in a manner such that the correction voltage ΔVp is added to the recording material part voltage Vp after the subsequent sampling of the secondary transfer current. Further, in the case where the controller 50 discriminates in S205 that the detected current falls within the predetermined current range, the controller 50 causes the sequence to go to a process of S207 without carrying out the secondary transfer voltage change on the basis of the present sampling result (that is, the secondary transfer voltage is kept at the present value).

Incidentally, in this embodiment, the leading end portion of the recording material P is the margin region where the toner image is not transferred onto the recording material P with respect to the recording material feeding direction and was a region of about 6 mm from the leading end toward the trailing end side of the recording material P in which the influence on the image is small.

Then, the controller 50 executes the limiter control (sheet interval control) for a region (other than the leading end portion) on the trailing end side than the leading end portion of the recording material P. Also in the sheet interval control, similarly as in the leading end control, the sampling of the secondary transfer current is performed for a certain time by the current detecting portion 21, and the sampled detected currents are averaged (S208). In this embodiment, the sampling time in this case is about 10 ms similarly as in the leading end control. However, for example, for the purpose of alleviating the calculation load at the controller 50, a longer sampling time may also be employed. The controller 50 discriminates whether or not the averaged detected current is out of the predetermined current range (the lower limit current value or more and the upper limit current value or less) (S209). The predetermined current range in this case may also be the table value stored in the ROM 53 similarly as in the leading end control.

In the case where the controller 50 discriminated in S209 that the detected current is out of the predetermined current range, the controller 50 acquires the correction voltage ΔVp and adjusts the present secondary transfer voltage Vtr by adding or subtracting this correction voltage ΔVp (S210). In this embodiment, also in the sheet interval control, the correction voltage ΔVp is acquired similarly as in the leading end control. However, in the sheet interval control, the correction voltage ΔVp which is the secondary transfer voltage change amount per once is a secondary transfer voltage change amount corresponding to about 0.3 μA/mm which is the secondary transfer current change amount per unit feeding distance of the recording material P. By this, in the sheet interval control, the secondary transfer voltage is adjusted more moderately than the leading end control, so that the density non-uniformity can be suppressed. Incidentally, similarly as the leading end control, in the case where ΔVp is corrected, some time lag occurs in the change of output of the secondary transfer voltage source 20. For that reason, in this embodiment, as shown in FIG. 9, a stand-by time is provided in a period until subsequent sampling is performed.

Thereafter, the controller 50 repetitively executes the sheet interval control until the trailing end of the recording material P reaches the secondary transfer portion N2 (S211). Then, the controller 50 ends the secondary transfer control when the trailing end of the recording material P reaches the secondary transfer portion N2 (S212). Further, in the case where the controller 50 discriminates in S209 that the detected current falls within the predetermined current range, the controller 50 does not make the change of the secondary transfer voltage on the basis of a present sampling result, and the sequence goes to a process of S211 (that is, the secondary transfer voltage is maintained at a present value).

FIG. 12 is a graph schematically showing an example of a progression of a detected current in the leading end control and the sheet interval control. FIG. 12 shows the example of the case where the electric resistance of the recording material P was high and the secondary transfer current fell below the lower limit current value of the predetermined current range. In this embodiment, in the case where detection that the secondary transfer current fell below the lower limit current value was made, the secondary transfer current is corrected toward the lower limit current value by changing the secondary transfer voltage with a change amount per once larger in the leading end control than in the sheet interval control. By this, in the leading end control, the secondary transfer current can be corrected toward the predetermined current range more quickly than the sheet interval control, so that improper transfer at the leading end portion of the recording material P can be suppressed. On the other hand, in the sheet interval control, an abrupt change in secondary transfer current is suppressed, so that the density non-uniformity at the central portion of the recording material P can be suppressed.

Thus, in this embodiment, in the control of the voltage applied to the transfer member 8 on the basis of the detection result of the current detecting portion 21 when each of the leading end portion and the central portion of the recording material P with respect to the recording material feeding direction passes through the transfer portion N2, the controller 50 changes the voltage applied to the transfer member 8 every predetermined change range. Further, the predetermined change range is larger when the leading end portion passes through the transfer portion N2 than when the central portion passes through the transfer portion N2.

As described above, an effect similar to the effect of the embodiment 1 can be expected also by making the voltage change range in the leading end control larger than the voltage change range in the sheet interval control as in this embodiment.

Other Embodiments

The present invention was described above based on specific embodiments, but is not limited to the above-described embodiments.

In the above-described embodiments, the control in the case where the region with respect to the recording material feeding direction is divided into the two regions consisting of the leading end portion and the portion other than the leading end portion was described, but the region may also be divided into three or more regions. For example, in a region closer to the leading end of the recording material with respect to the recording material feeding direction, the transfer voltage changeable amount per once can be made larger. Further, the transfer voltage changeable amount per once at the trailing end portion (particularly at the margin portion) with respect to the recording material feeding direction may also be made larger than the transfer voltage changeable amount per once at a sheet interval portion with respect to the recording material feeding direction. This is because similarly as in the case of the leading end portion, the trailing end portion is the non-image forming region or is high in proportion of the non-image forming region and therefore the density non-uniformity does not readily appear.

Further, respective numerical values of the sampling time, the correction voltage ΔVp and the like are not limited to the values in the above-described embodiments, but can also be appropriately set depending on the structure or the like of the image forming apparatus.

Further, the limiter control can also be performed by providing either one of the upper limit and the lower limit of the control. For example, in the case where the recording material larger in electric resistance than the normal recording material is used and it is known that the transfer current falls below the lower limit, only the lower limit can be provided. On the other hand, in the case where the recording material smaller in electric resistance than the normal recording material is used and it is known that the transfer current falls above the upper limit, only the upper limit can be provided. That is, the control such that the transfer current is caused to fall within the predetermined range in the limiter control includes the cases where the transfer current is made the upper limit or less, the lower limit or more, and the upper limit or less and the lower limit or more.

Further, the present invention is also similarly applicable to a monochromatic image forming apparatus including only one image forming portion. In this case, the present invention is applied to a transfer portion where the toner image is transferred from the image bearing member such as the photosensitive drum onto the recording material.

According to the present invention, in the constitution in which the limiter control is carried out, it is possible to suppress the density non-uniformity in the neighborhood of the central portion of the recording material P with respect to the recording material feeding direction while suppressing the improper transfer at the leading end portion of the recording material P with respect to the recording material feeding direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-122575 filed on Jun. 29, 2019, which is hereby incorporated by reference herein in its entirety.

What is claimed is:

1. An image forming apparatus comprising:

an image bearing member configured to bear a toner image;

a transfer member configured to transfer the toner image from the image bearing member onto a recording material at a transfer position by being applied a voltage;

a voltage source configured to apply the voltage to the transfer member;

a current detecting portion configured to detect a current flowing through the transfer member; and a controller configured to control the voltage source while the recording material passes through the transfer portion, wherein the controller is configured to perform constant voltage control so that the voltage applied from the voltage source becomes a target voltage in a case in which the detection result detected by the current detecting portion is in a predetermined range, which is defined by at least one of an upper limit value and a lower limit value determined based on the type of the recording material, wherein, in a case in which the detection result is out of the predetermined range, the controller is configured to adjust the target voltage so that the detection result falls within the predetermined range, and perform the constant voltage control with the adjusted target voltage, and wherein, while the recording material passes through the transfer position in a case in which the detection result detected by the current detection portion exceeds a predetermined amount from the predetermined range, a change amount of the target voltage which the controller changes is a first change amount or larger when the leading end portion of the recording material with respect to a feeding direction of the recording material passes through the transfer position, and the change amount of the target voltage is a second amount that is less than the first change amount when a central portion of the recording material passes through the transfer position.

2. An image forming apparatus according to claim 1, wherein the controller controls the change amount of the target voltage that the controller changes such that:

(i) in a case in which the detection result detected by the current detection portion exceeds the predetermined amount from the predetermined range, a change amount of a current flowing through the transfer member by one change of the target voltage is the predetermined amount or larger when the leading end portion of the recording material with respect to the feeding direction of the recording material passes through the transfer position, and (ii) in a case in which the detection result detected by the current detection portion exceeds the predetermined amount from the predetermined range, the change amount of the current flowing through the transfer member by one change of the target voltage is less than the predetermined amount when the central portion of the recording material with respect to the feeding direction of the recording material passes through the transfer position.

3. A image forming apparatus according to claim 1, wherein the controller controls the change amount of the target voltage that the controller changes such that:

(i) in a case in which the detection result detected by the current detection portion exceeds the predetermined amount from the predetermined range, the change amount of the current flowing through the transfer member by one change of the target voltage is a first predetermined amount less than the predetermined amount or less when the leading end portion of the recording material with respect to the feeding direction of the recording material passes through the transfer position, and (ii) in a case in which the detection result detected by the current detection portion exceeds the predetermined amount from the predetermined range, the change amount of the current flowing through the transfer member by one change of the target voltage is a second predetermined amount less than the first predetermined amount or less when the central portion of the recording material with respect to the feeding direction of the recording material passes through the transfer position.

4. An image forming apparatus according to claim 1, wherein, in a case in which the detection result is out of the predetermined range, while the recording material passes through the transfer position the controller changes the target voltage on the basis of a voltage-current characteristic acquired by applying a voltage to the transfer portion in a state in which the recording material is absent at the transfer portion.

5. An image forming apparatus according to claim 1, wherein the leading end portion of the recording material is a margin region where the toner image is not transferred onto the recording material on a leading end side of the recording material with respect to the recording material feeding direction.

6. An image forming apparatus according to claim 1, wherein the image bearing member is an intermediary transfer member configured to feed the recording material for secondary-transferring the toner image primary-transferred from another image bearing member.

* * * * *